US007032332B2

(12) United States Patent
Sharkness et al.

(10) Patent No.: US 7,032,332 B2
(45) Date of Patent: Apr. 25, 2006

(54) METHOD OF CONTROLLING A BACKHOE

(75) Inventors: Eric Sharkness, Troy, MI (US); Dennis Heyne, Burlington, IA (US); Richard J. Lech, Burlington, IA (US)

(73) Assignee: CNH America LLC, New Holland, PA (US)

( * ) Notice: Subject to any disclaimer, the term of this patent is extended or adjusted under 35 U.S.C. 154(b) by 395 days.

(21) Appl. No.: 10/443,473

(22) Filed: May 22, 2003

(65) Prior Publication Data

US 2003/0226292 A1 Dec. 11, 2003

Related U.S. Application Data

(62) Division of application No. 09/962,894, filed on Sep. 25, 2001, now Pat. No. 6,941,687.

(51) Int. Cl.
*E02F 1/00* (2006.01)

(52) U.S. Cl. ..... 37/195; 37/348; 60/468; 60/466

(58) Field of Classification Search ..... 37/348, 37/382; 172/2, 3, 6; 91/420, 454; 60/460, 60/450, 468, 466
See application file for complete search history.

(56) References Cited

U.S. PATENT DOCUMENTS

| | | | | |
|---|---|---|---|---|
| 3,407,946 A | | 10/1968 | Pilch | 414/695.5 |
| 3,815,766 A | | 6/1974 | Carlson et al. | 414/695.5 |
| 4,126,152 A | * | 11/1978 | Kirk | 137/85 |
| 4,194,365 A | * | 3/1980 | Stoufflet et al. | 60/468 |
| 4,586,332 A | | 5/1986 | Schexnayder | 60/468 |
| 4,628,690 A | | 12/1986 | Arai et al. | 60/464 |
| 4,718,329 A | | 1/1988 | Nakajima et al. | 91/445 |
| 5,018,934 A | | 5/1991 | Steinkamp et al. | 414/695.5 |
| 5,025,626 A | | 6/1991 | Crosser et al. | 60/460 |
| 5,048,296 A | | 9/1991 | Sunamura et al. | 60/468 |
| 5,413,452 A | | 5/1995 | Lech et al. | 414/695.5 |
| 5,424,623 A | | 6/1995 | Allen et al. | 318/568.18 |
| 5,471,908 A | | 12/1995 | Lech | 91/516 |
| 5,609,088 A | * | 3/1997 | Park | 91/420 |
| 5,709,083 A | | 1/1998 | Sorbel et al. | 60/394 |
| 5,897,287 A | * | 4/1999 | Berger et al. | 414/699 |
| 6,356,829 B1 | | 3/2002 | Fan et al. | 701/50 |
| 6,398,277 B1 | | 6/2002 | McDonald | 294/1.2 |
| 6,474,064 B1 | | 11/2002 | Heyne et al. | 60/468 |
| 6,532,738 B1 | * | 3/2003 | Sharkness et al. | 60/468 |
| 6,640,409 B1 | * | 11/2003 | Sharkness et al. | 29/401.1 |

* cited by examiner

*Primary Examiner*—Victor Batson
(74) *Attorney, Agent, or Firm*—John William Stader; Stephen A. Bucchianeri; Michael C. Harms

(57) ABSTRACT

An electronic control for damping oscillation of a swinging backhoe assembly includes a crossover valve that connects the hydraulic lines that supply hydraulic fluid to the boom swing cylinders to each other whenever an electronic controller senses incipient oscillation or swinging of the backhoe assembly. The electronic controller senses such parameters as pressure in the conduits and the position of the operator controls or the position of the boom swing control valve that the operator controls to determine incipient oscillation when the backhoe assembly is stopped. The crossover valve may remain open for a predetermined period of time.

9 Claims, 7 Drawing Sheets

METHOD OF CONTROLLING A BACKHOE

This is a divisional of application Ser. No. 09/962,894, filed on Sep. 25, 2001 now U.S. Pat. No. 6,941,687.

FIELD OF THE INVENTION

The invention relates generally to methods and apparatus for controlling the oscillation of elongate members. More particularly, it relates to hydraulic circuits for moving those members and methods and apparatus for controlling those circuits to stop such oscillations.

BACKGROUND OF THE INVENTION

Many work vehicles have elongate members or linkages that are controlled by hydraulic actuators. When the hydraulic actuators are filled with fluid, typically under the control of hydraulic spool valves, the members move with respect to the work vehicle. When the spool valves are closed, hydraulic fluid stops flowing to the hydraulic actuators and the members stop moving.

When the members are particularly long, or are connected to one another using mechanical linkages that are loose, the relatively sudden closing of the hydraulic valves causes the hydraulic actuators to abruptly stop moving. The sudden halt to the motion of the hydraulic actuators does not immediately stop the motion of the members themselves. Typically, and especially for elongate members or linkages such as backhoe attachments connected to work vehicles such as tractors, the members flex and oscillate back and forth for a period of four or five seconds before finally coming to a halt.

When the work vehicle is being used for precise operations such as digging a very narrow trench that is just the width of a backhoe bucket attached to the end of the elongate member, the operator must wait until the oscillations cease before lowering the bucket into the narrow trench. This delay causes a significant reduction in work vehicle productivity. In many cases the operator must reposition the elongate members using the hydraulic valve once they have stopped oscillating.

This oscillation is due to the spring-like behavior of the elongate members and their hydraulic actuators. When the hydraulic valve is closed, the hydraulic actuators stop moving instantly. The inertia of the elongate members extending outward from the vehicle tends to keep the elongate members moving. As the elongate members attempt to keep moving, the lower portion of the members (i.e. the end that is pivotally attached to the work vehicle) butts up against the now-stopped hydraulic actuators, causing a sudden spike in hydraulic pressure in the actuators. The actuators, which are fixed in their extended position since the valve has closed, resist the force applied to them by the elongate members and stop essentially all motion. As a result, the free end of the elongate member flexes, and its kinetic energy is converted into potential energy in the form of any elastically bent elongate member, pressurized hydraulic fluid in the hydraulic actuator, and perhaps slightly elastically expanded hydraulic hoses and actuators.

As the elongate members slow to a halt and their kinetic energy is converted into potential energy, the potential energy is then released and converted back into kinetic energy again as the elongate members begin to swing back in the opposite direction.

This reversal of direction causes the same process to occur in the reverse direction. The actuators, rebounding from the now-fixed actuator, increase in speed until they begin to pressurize the fluid in the actuator in the other direction, at which point they begin slowing down as the pressure increases in the actuator until the elongate members are again stopped. The elongate members then begin moving back in the original direction once again. This back and forth motion of the elongate members continues for as many as five seconds until finally its energy is completely dissipated, at which point they slow to a halt.

Depending upon the inertia and momentum of in the elongate members, the pressure spike in hydraulic actuators that move the elongate members can be substantial. Oftentimes, the kinetic energy pressure spike is several times as large as the maximum operational pressure of the hydraulic actuators. Previous attempts to reduce this unwanted oscillation have capitalized on this difference between the working pressure and the sudden pressure pulse experienced by the hydraulic actuator. In these prior art efforts, a hydraulic relief valve is coupled to the ports of the hydraulic actuators to permit the escape of fluid thereby damping the oscillations. This relief pressure is significantly greater than the operating pressure of the hydraulic actuators, typically on the order of 2500 psi. By comparison, the actual operating pressure of a backhoe swing cylinder—the hydraulic actuator that pivots a backhoe attachment—is typically 900 psi.

One of the problems with relying only relief valves to reduce elongate member oscillation is the fact that the relief valve pressure setting must of necessity be greater than the typical operating pressure of the hydraulic actuator. Since pressure relief valves are continuously connected between a hydraulic actuator and a low-pressure hydraulic tank or reservoir their relief pressure setting must be above that of the maximum desired operating pressure, or that operating pressure would never be reached. It is for this reason that the overpressure relief valves cannot be relied upon to reduce the oscillation of the elongate members, due to this sudden pressure spike when the hydraulic valve is closed.

Since the relief pressure is set so high, the overpressure relief valves will only pass hydraulic fluid (and dissipate the members' potential energy) to a limited extent. A substantial amount of the potential energy remains stored in the system, however, and can only be dissipated by the oscillations of the elongate members. Indeed, oscillations can occur when the pressure in the actuator is as low as 300–400 psi, well below the pressure at which the relief valves open.

For this reason, a simple pressure relief valve cannot function to substantially reduce the oscillations of the elongate member.

A swing-damping system is shown in co-pending patent application Ser. No. 09/661,348 filed on Sep. 14, 2000, entitled "Hydraulic System and Method for Regulating Pressure Equalization to Suppress Oscillation in Heavy Equipment", and assigned to Case Corporation (assignee of the present application). In that application, a hydraulic circuit for damping unwanted oscillations or swing of an elongate member of a work vehicle is also shown.

In the system of the '348 application, a backhoe is shown with a purely hydraulic swing damping circuit coupled to and between a bi-directional hydraulic valve (called a "boom swing valve") and two bi-directional dual-ported boom swing cylinders that are coupled between a backhoe attachment (the elongated members in this application) and a work vehicle to which the attachment is pivotally coupled.

This swing-damping circuit of the '348 application responds to pressure in the boom swing cylinder that is generated by the boom as it slows down and decelerates, pushing against the actuator. This state occurs whenever the boom swing valve is closed so far that it does not permit sufficient fluid out of the cylinder to accommodate the already-moving boom swing cylinder piston. A pressure pulse is generated in the boom swing cylinders when the hydraulic valve controlling fluid flow to and from those cylinders is suddenly closed and the backhoe boom impacts the suddenly stopped boom swing cylinder piston. This sudden spike in pressure, typically greater than the ordinary operating pressure of the cylinder and hydraulic valve controlling the cylinder, applies a hydraulic pressure to one side of a small hydraulic valve spool in a bypass or crossover circuit. This pressure spike causes the valve spool to shift and permits fluid to flow from the port of boom swing cylinder experiencing the sudden pressure spike to the opposing boom swing cylinder port. The spool and its associated hydraulic circuitry are arranged such that this additional flow path from one boom cylinder port to the other port closes shortly after it opens. Thus, for a short period of time after the hydraulic valve is closed, fluid is permitted to flow between the cylinder ports, and reducing excessively low pressure at the boom swing cylinder port used for initial acceleration, thus breaking the cycle of kinetic energy to potential energy to kinetic energy to potential energy oscillations.

OBJECTS AND SUMMARY OF THE INVENTION

It is an object of this invention to provide an improved swing damping system to damp the incipient oscillation of elongate members with respect to a work vehicle to which they are attached. It is a further object to provide improved swing damping to damp the incipient oscillation of a backhoe assembly with respect to the tractor to which it is attached. It is yet another object of this invention to provide an electronic controller that is responsive to electrical signals that represent physical parameters of a work vehicle, wherein the physical parameters indicate incipient oscillation of elongate members with respect to the vehicle and to electronically control a valve to reduce or eliminate the incipient oscillation before it occurs.

In accordance with a first embodiment of the invention, a backhoe is provided that comprises a work vehicle, a backhoe attachment pivotally coupled to the work vehicle and including a boom base, a boom pivotally coupled to the boom base, and a dipper pivotally coupled to the boom, wherein the boom base is constrained to pivot with respect to the work vehicle about a substantially vertical axis, at least one dual-ported hydraulic actuator having first and second input ports wherein the actuator is coupled between the vehicle and the boom base and is disposed to pivot the boom base with respect to the vehicle about the substantially vertical axis, a bi-directional control valve having first and second output ports, a first hydraulic conduit coupled between the first input port and the first output port and configured to conduct hydraulic fluid in an amount and at a pressure sufficient to swing the backhoe attachment with respect to the vehicle in a first direction, a second hydraulic conduit fluidly coupled between the second input port and a second output port and configured to conduct hydraulic fluid in an amount and at a pressure sufficient to swing the backhoe attachment with respect to the vehicle in a second direction, at least one electronically actuated bypass valve coupled to the first and second conduits and configured to conduct fluid from the first and second ports of the hydraulic actuator, an electronic controller coupled to the at least one bypass valve and configured to open the valve in response to at least one signal indicative of incipient boom oscillation.

The bypass valve may be configured to conduct fluid from the first port to the second port. The backhoe may include a sensor coupled to the controller and configured to generate the at least one signal indicative of incipient boom oscillation. The sensor may be configured to generate a signal indicative of valve position and the at least one signal indicative of incipient boom oscillation may include a sensor signal indicative of the valve being closed. The sensor is configured to generate a signal indicative of a desired valve position. The at least one signal indicative of incipient boom oscillation may include a sensor signal indicative of a valve close command. The backhoe may include a pressure sensor fluidly coupled to at least one of the first and second conduits, and coupled to the electronic controller to provide the controller with a pressure signal indicative of hydraulic fluid pressure, wherein the electronic controller may be configured to open the bypass valve based at least in part on the pressure signal exceeding a value indicative of incipient boom oscillation. The electronic controller may be configured to close the bypass valve after a predetermined time interval, wherein the time interval may be of a length sufficient to damp boom oscillation. The predetermined time interval may be less than one second. The predetermined time interval may be less than 600 milliseconds. The predetermined time interval may be less than 300 milliseconds.

In accordance with a second embodiment of the invention, a hydraulic swing damping system is provided for a backhoe including a work vehicle with a backhoe implement that may be configured to be pivoted about a substantially vertical axis with respect to the vehicle by at least one dual-ported hydraulic cylinder, and a bi-directional control valve coupled to the dual-ported hydraulic cylinder by first and second supply conduits, the system including a bypass conduit configured to be fluidly coupled between the first and second supply conduits, an electrically-actuated bypass valve disposed in the conduit to control fluid flow therethrough, an electronic controller electrically coupled to the bypass valve to selectively open and close the bypass valve, and a sensor configured to be coupled to the backhoe and responsive to a physical parameter indicative of incipient backhoe attachment oscillation, wherein the electronic controller may be configured to (a) open the bypass valve in response to at least one signal indicative of incipient boom oscillation for a period sufficient to damp potential boom oscillation, and (b) close the bypass valve once an amount of hydraulic fluid sufficient to damp the potential boom oscillation has passed through the valve. The sensor may be a pressure sensor configured to generate a pressure signal indicative of a hydraulic pressure in the boom swing cylinder, and further wherein the controller may be configured to open the bypass valve based upon the pressure signal. The sensor may be a position sensor configured to generate a signal indicative of a position of the control valve. The position of the control valve may be a valve-closed position.

In accordance with a third embodiment of the invention, a method of swing damping in a backhoe including a work vehicle, a backhoe implement pivotally coupled to the work vehicle, a boom swing cylinder coupled to the implement and the vehicle to pivot the implement with respect to the vehicle, a bi-directional hydraulic control valve fluidly coupled to the cylinder to control the flow of hydraulic fluid flow thereto, an electronic bypass valve fluidly coupled between two ports of the hydraulic cylinder to permit hydraulic fluid flow therebetween, and an electronic controller electrically coupled to the bypass valve to drive the bypass valve, the method including electronically monitoring in the electronic controller at least one physical parameter indicative of the incipient oscillation of the backhoe attachment with respect to the vehicle, determining in the electronic controller whether the incipient oscillation may be going to occur, electronically opening the bypass valve by the electronic controller if the incipient oscillation has been determined to occur in the foregoing step, maintaining the bypass valve in an open condition until a quantity of fluid sufficient to damp incipient oscillation has passed through the bypass valve, and closing the bypass valve once the quantity of fluid has passed through the bypass valve.

The step of electronically monitoring may include the step of reading an electronic sensor signal indicative of a pressure in the boom swing cylinder and wherein the step of determining may include the step of determining whether the pressure may be indicative of the incipient oscillation. The step of electronically monitoring may include the step of reading an electronic sensor signal indicative of a position of the directional valve and wherein the step of determining may include the step of determining whether the position may be indicative of the incipient oscillation. The step of maintaining the bypass valve in an open condition may include the step of maintaining the valve in an open condition for a predetermined period of time. The predetermined period of time may be less than 1 second. The predetermined period of time may be less than 600 milliseconds. The predetermined period of time may be less than 300 milliseconds. The quantity of fluid in the step of maintaining the bypass valve in an open condition may be insufficient to permit the boom to pivot through an angle relative to the work vehicle of more than 10, or 5 degrees, or 3 degrees.

DESCRIPTION OF THE PREFERRED EMBODIMENT

Figure 1:
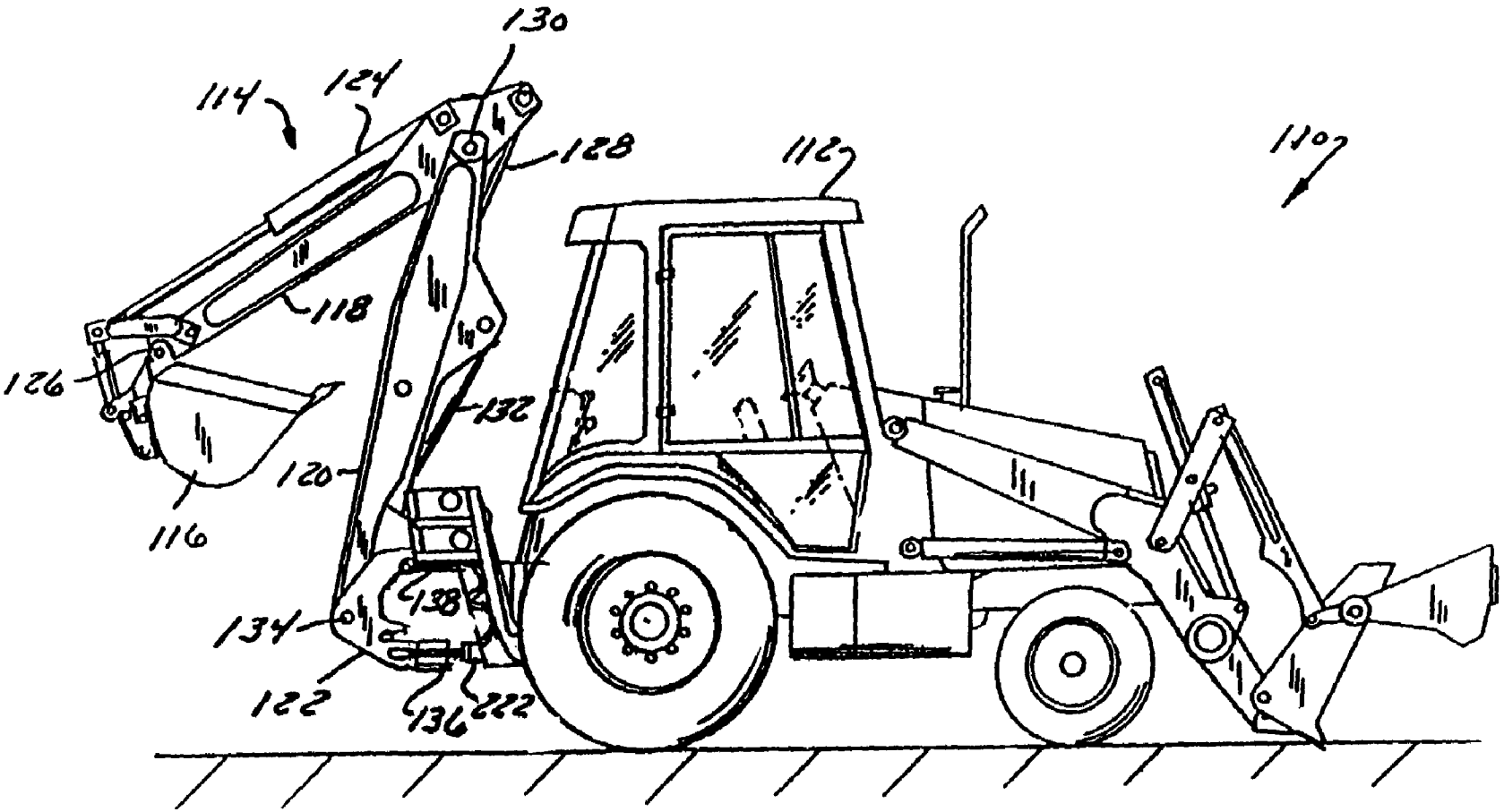
FIG. 1 is a side view of a backhoe comprising a work vehicle with a backhoe attachment.

FIG. 1 is a side view of a backhoe 110 including a vehicle 112, and a backhoe attachment or assembly 114, shown herein as an elongate member, that is pivotally coupled to the vehicle.

The backhoe assembly includes a bucket 116 that is pivotally coupled to a dipper 118 that, in turn, is pivotally coupled to a boom 120 which, in turn, is pivotally coupled to a boom base 122, which, in turn, is pivotally coupled to vehicle 112.

Bucket 116 is pivoted with respect to dipper 118 by bucket hydraulic cylinder 124 which, when it extends and retracts, opens and closes bucket 116 pivoting it about pivot joint 126. Pivot joint 126 defines a substantially horizontal pivotal axis for bucket 116.

Dipper 118 is pivoted with respect to boom 120 by dipper hydraulic cylinder 128 about pivot, joint 130. When dipper cylinder 128 retracts, it raises dipper 118. When dipper cylinder 128 extends, it lowers dipper 118. Pivot joint 130 defines a substantially horizontal pivotal axis for the pivoting of dipper 118 with respect to boom 120.

Boom lift hydraulic cylinder 132 is coupled to boom 120 and boom base 122 to raise and lower boom 120 with respect to boom base 122. Boom 120 pivots with respect to boom base 122 about pivot joint 134 which couples boom 120 to boom base 122. When boom cylinder 132 extends, boom 120 is lowered with respect to boom base 122 when boom lift cylinder 132 retracts, boom 120 is raised with respect to boom base 122.

Boom base 122 pivots with respect to vehicle 112 about two pivot joints 138 and 136 that couple boom base 122 to vehicle 112. These two pivot joints define a substantially vertical pivotal axis about which boom base 122 rotates with respect to vehicle 112.

Two boom swing hydraulic cylinders 222 are coupled between vehicle 112 and boom base 122 to pivot boom base 122 with respect to vehicle 112 about the vertical axis.

FIG. 2 illustrates in schematic form a first embodiment of the oscillation reduction circuit 210 employed in conjunction with a directional control valve 212 to supply hydraulic fluid under pressure to elongate member 114 (here shown as a backhoe attachment) to reduce the unwanted oscillation of the backhoe attachment about a vertical axis when the directional control valve 212 is closed.

Circuit 210 includes bypass conduit 216 that fluidly couples the two supply conduits 218 and 220 that supply fluid to hydraulic actuators 222 and 224 (here shown as boom swing cylinders). This conduit is called a "bypass" conduit, since it permits fluid to flow between the supply conduits without first passing through the directional control valve that is controlled by the operator. In an alternative embodiment, the bypass conduit may provide bypass flow between the boom swing cylinders and a hydraulic tank or reservoir. In such an embodiment it would be desirable to provide an anti-cavitation or similar valve to permit replacement or makeup fluid to flow into the other port of the cylinder.

An electronic flow control valve 226 is disposed in bypass conduit 216 to block or permit fluid flow through conduit 216 from one supply conduit 218, 220 to the other. An electronic valve controller 228 is electrically coupled to flow control valve 226 to controllably move it between an open and a closed position. Two pressure transducers, 230 and 232, are fluidly coupled to conduits 218 and 220, respectively, to sense conduit pressure and signal controller 228 of the pressure in their respective conduits. In this manner, controller 228 is aware of changes in pressure of the supply conduits 218, 220. Note that the specific location of the pressure transducers is not critical in the present invention. Since the pressure transducers are intended to respond to pressure spikes generated in hydraulic actuators 222 and 224 when elongate member 114 causes a pressure spike, the two transducers 230 and 232 could be disposed to sense pressure at any point along the fluid supply path.

Figure 2B:
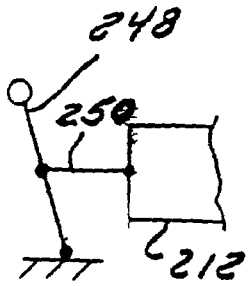
FIG. 2B is a fragmentary schematic of the control system of FIG. 2A showing the directional control valve of FIG. 2A with a hand-operated mechanical actuator in place of the joystick and controller 242.
Figure 2A:
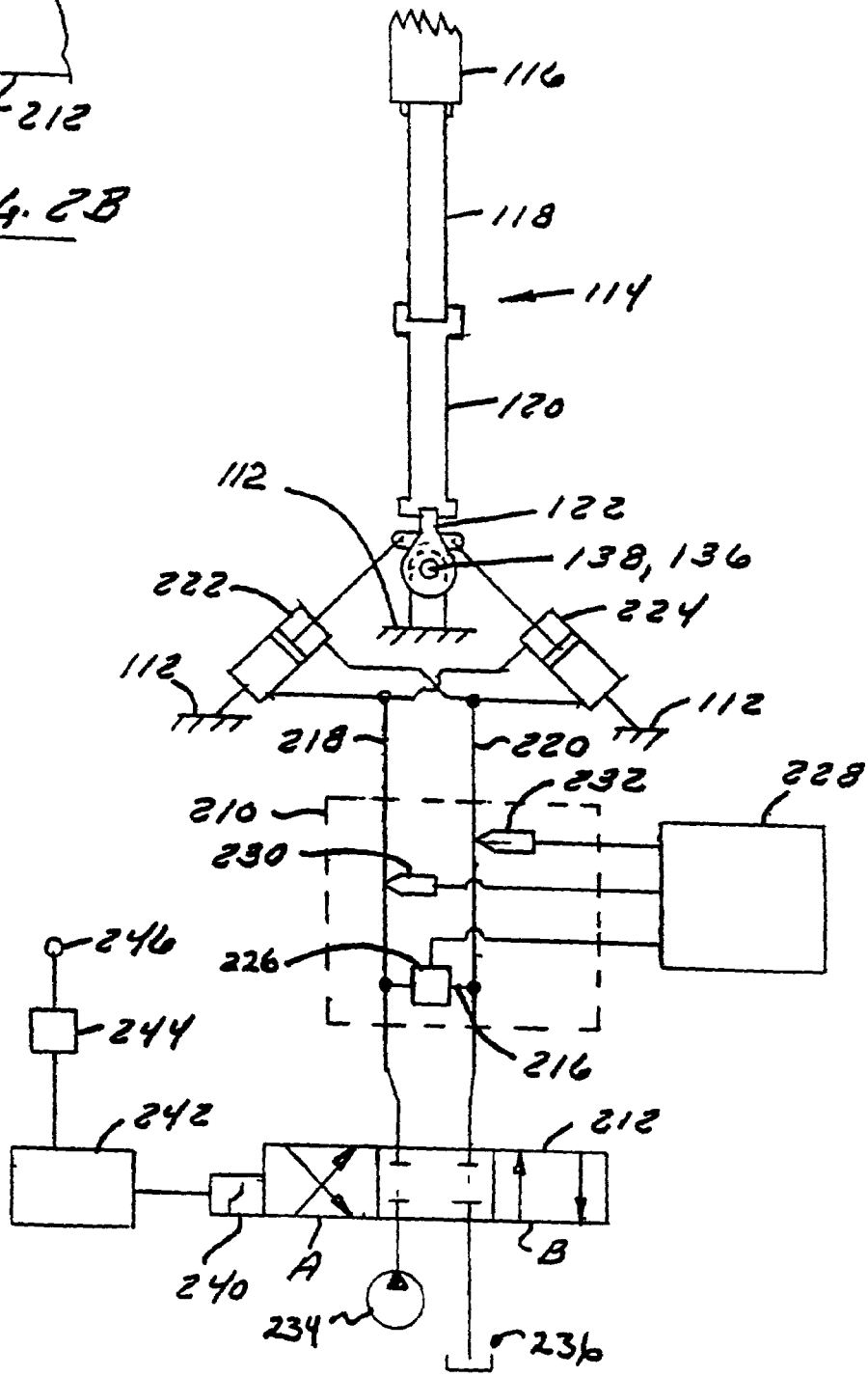
FIG. 2A is a top view of the backhoe attachment of FIG. 1 together with the boom swing cylinders that pivot the boom base with respect to the vehicle of FIG. 1 as well as a first embodiment of the electronic control system for reducing or eliminating incipient backhoe attachment oscillation when the backhoe is stopped.

In operation, the operator moves valve 212 from its central closed "off" position shown in FIG. 2A to one of two other positions A and B, in which fluid flow is permitted to pass from a source of hydraulic fluid under pressure 234 into actuators 222 and 224, and to permit corresponding an equivalent flow from actuators 222 and 224 back to a hydraulic tank or reservoir 236. Using the embodiment of FIG. 2A as an example, when the operator moves valve 212 to position A, hydraulic fluid flows into actuators 222 and 224 through conduit 220 causing the elongate member 114 to pivot about joints 136, 138 in a counterclockwise direction as shown in FIG. 2A. The two actuators 222 and 224 are cross-linked so that when hydraulic fluid is provided through conduit 220 it is supplied to the two actuators such that actuator 222 retracts as actuator 224 extends. This, in turn, applies a torque to elongate member 114 about pivot joints 136, 138 causing the elongate member to rotate in a counterclockwise direction.

The operator can also move valve 212 to position B. In this position, hydraulic fluid flows from the fluid source 234 through valve 212 and into actuators 222 and 224 through conduit 218. In addition, hydraulic fluid from the actuators in an equal amount flows back to tank 236 through conduit 220 and valve 212.

Valve 212 is shown as being operated by an electrical solenoid 240. The solenoid, in turn, is electrically coupled to valve controller 242. Valve controller 242 is a microprocessor-based controller that determines the signal to be applied to solenoid 240 in order to open the valve to the appropriate position requested by the operator. The operator commands to open the valves are generated by a joystick 244, which is electrically coupled to controller 242 to generate and transmit signals indicative of the joystick position to the controller. Joystick 244 generates electrical signals based upon the operator's manipulation of the joystick handle 246. When the operator wishes to move valve 212, he manipulates handle 246 which generates a signal in joystick 244, which in turn sends an electrical signal to controller 242, which in turn sends a corresponding electrical signal to solenoid 240 and shifts the valve to the position requested by the operator.

FIG. 2B shows an alternative arrangement of valve 212 in which the operator moves an alternative handle 248, which is connected via mechanical linkage 250 to valve 212. In the embodiment of FIG. 2B, there is a direct mechanical linkage between the handle and the valve spool.

Figure 3:
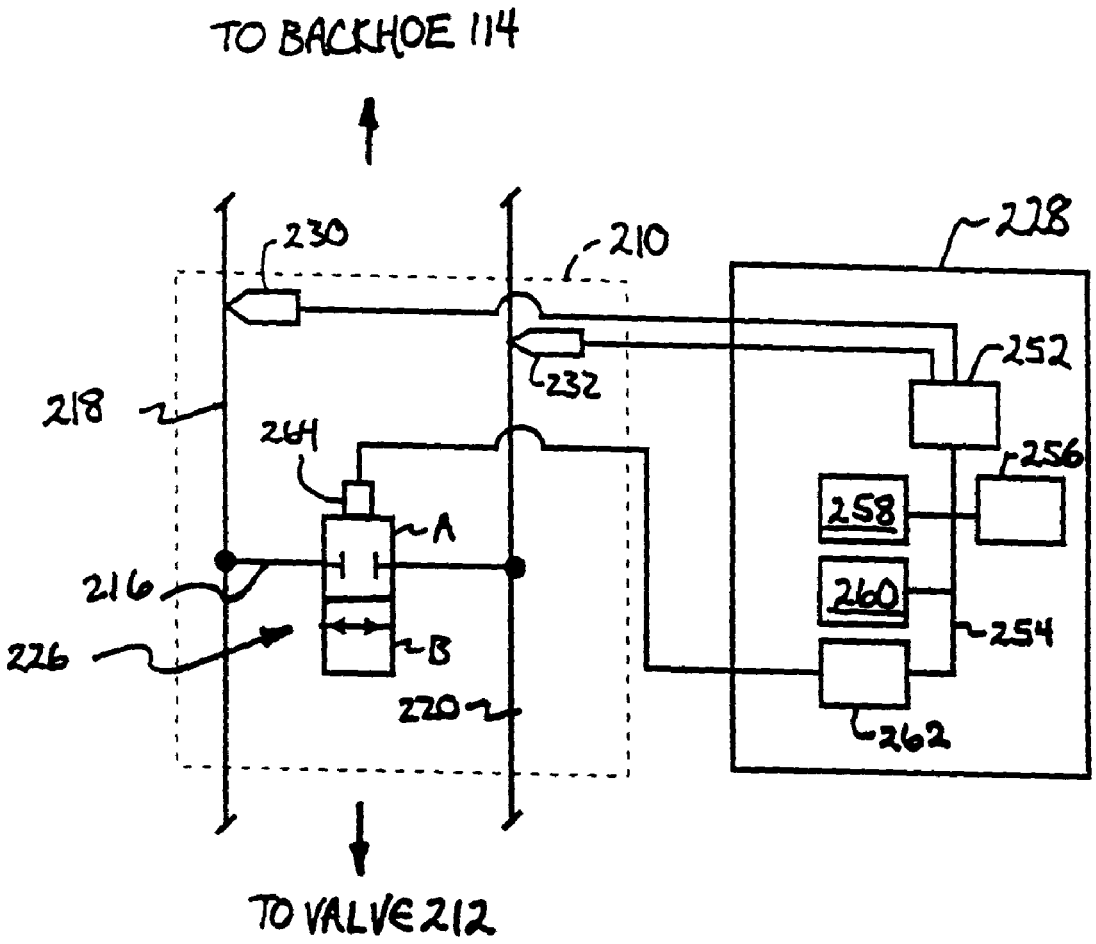
FIG. 3 is a detailed fragmentary schematic of the electronic and hydraulic circuit of FIGS. 2A and 2B showing the controller and pressure sensors in more detail.

Referring now to FIG. 3, details of the oscillation reduction circuit 210 and controller 228 to which it is coupled are shown in greater detail. Controller 228 includes a signal conditioning circuit 252 to which pressure transducers 230 and 232 are coupled. The signal conditioning circuit 252 transforms the signals received from the transducers into a form that can be placed on bus 254. Controller 228 also includes a microprocessor 256, random access memory (RAM) 258, and read only memory (ROM) 260, all coupled to bus 254. It also includes a valve driver circuit 262 that is coupled between bus 254 and electrical solenoid 264 of valve 226. Valve driver circuit 262 converts signals indicative of the valve position that are on bus 254 into a form that is directly usable by solenoid 264. In a preferred embodiment, valve driver circuit 262 receives a signal indicative of the desired degree of opening of valve 226 and converts it into a pulse-width modulated (PWM) waveform that, when applied to solenoid 264, will open or close valve 226 the desired amount.

Controller 228 operates under the control of microprocessor 256. Microprocessor 256 is configured to execute a computer program that is stored in ROM 260. RAM 258 is configured to be accessed by microprocessor 256 and to store values of working variables and pre-determined data structures needed by microprocessor 256 as it monitors pressure transducers 230 and 232 and controls valve 226.

Valve 226 is preferably a two-position valve, as shown in FIG. 3. In position A, all flow through bypass conduit 216 is substantially stopped, thus blocking fluid flow from conduit 218 to conduit 220 and from conduit 220 to conduit 218. In a second position, position B, valve 226 permits relatively free flow between conduit 218 and conduit 220. While valve 226 is shown here as a two-position valve, and in its simplest embodiment this is preferred, it may also be movable to a plurality of positions, each position corresponding to a different flow rate through the valve for a given pressure drop across the valve. While valve 226 is shown in FIG. 3 as a single valve, it may include a plurality of valves that are together configured to provide or suppress the bidirectional flow between conduits 218 and 220 described above.

In the embodiment of FIG. 3, the two pressure transducers 230, 232 provide signals that tell controller 228 that elongate member 114 may begin to oscillate. As noted above, one indication of incipient oscillation is a sudden pressure spike in the hydraulic actuators shown in FIG. 2A as boom swing cylinders 222 and 224. This is not the only way of determining that oscillation is imminent, however.

Oscillation of elongate member 114 occurs whenever the motion of the member is suddenly stopped by closing valve 212. It is the stop combined with the momentum of the elongate member as it tries to continue moving that causes a pressure spike sensed by pressure transducers 230 and 232.

Figure 4:
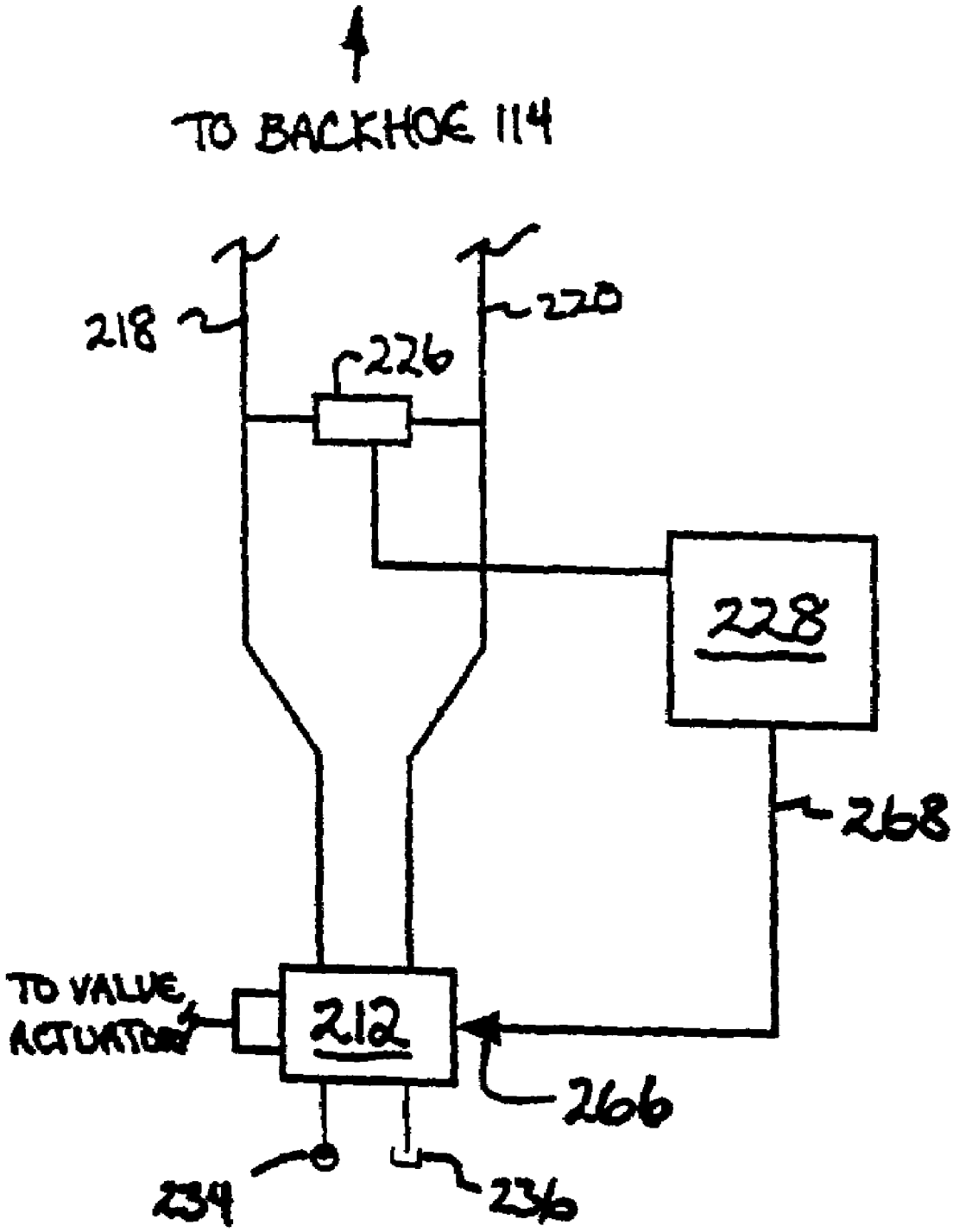
FIG. 4 is a partial schematic of the embodiment of FIG. 2A or 2B illustrating the addition of a valve position sensor to the FIG. 2A or 2B embodiment.

FIG. 4 shows an alternative embodiment of the system of FIG. 2A wherein a valve position sensor 266 has been substituted for pressure transducers 230 and 232. In FIG. 4, oscillation reduction circuit 210 and controller 228 are shown in an alternative form in which the pressure transducers are replaced with a position sensor 266 that is responsive to the position of valve 212. When valve 212 closes, position sensor 266 generates a signal indicative of the closed position. Signal line 268 extends between sensor 266 and controller 228 and is coupled to signal conditioning circuit 252 of FIG. 3 (not shown) in place of the two pressure transducers 230 and 232.

In the embodiment of FIG. 4, controller 228 determines whether and how to open or close valve 226 based upon the position of the valve 212.

Figure 5:
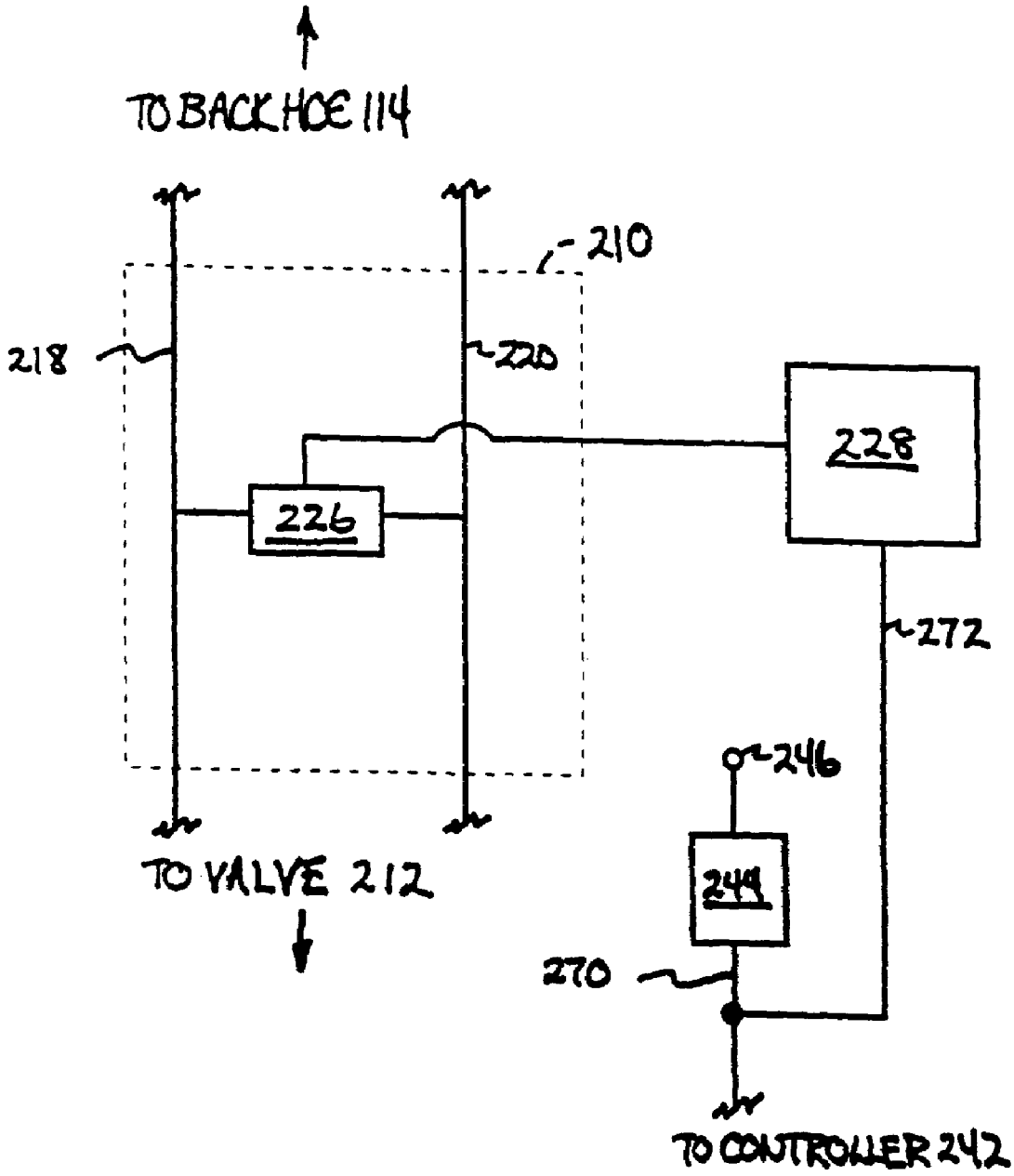
FIG. 5 is a fragmentary schematic of the embodiment of FIG. 2A in which a communication line is added between the controller and the joystick to transmit a joystick position signal generated by the joystick to the controller.

Alternatively, and as shown in FIG. 5, another embodiment of oscillation reduction circuit 210 and controller 228 is provided in which controller 228 responds to electrical signals generated by joystick 244 whenever the operator moves handle 246. In this embodiment, joystick 244 provides its handle position signal on signal line 270, which is electrically coupled to controller 242 and also on signal line 272 which is electrically coupled to controller 228. Signal line 272 is coupled to signal conditioning circuit 252 in place of position sensor 266 and pressure transducers 230 and 232. The operator's movement of handle 246 to a position indicating valve closure provides an indication to controller 228 that the unwanted oscillation of elongate member 114 may begin. Hence, the signal generated by joystick 244 when the operator moves handle 246 is another way of indicating to controller 228 that unwanted oscillations are incipient and that valve 226 should be opened.

Figure 6:
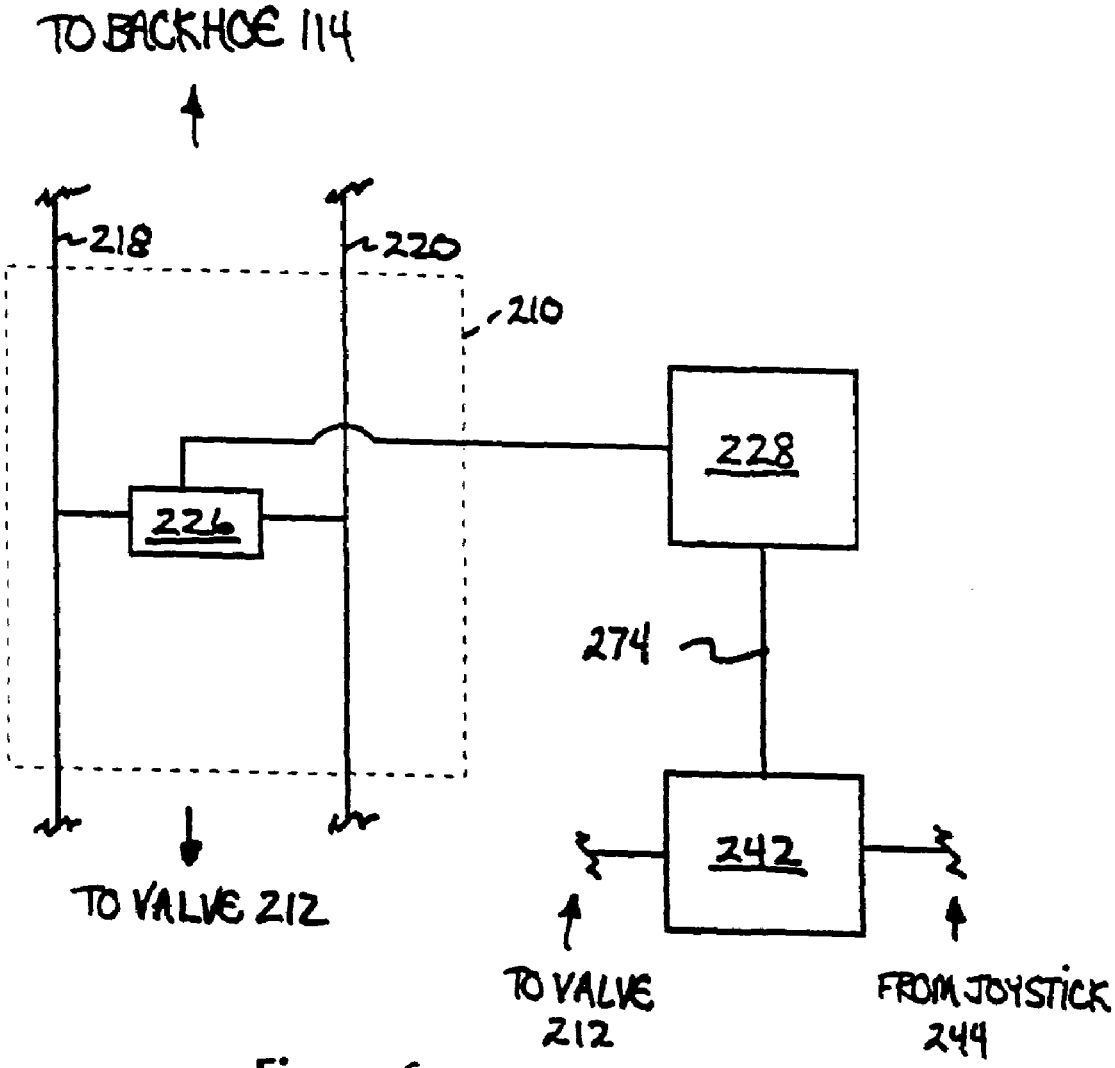
FIG. 6 is a fragmentary schematic view of the embodiment of FIG. 2A in which a communication line is added between the joystick controller of FIG. 2A and the bypass valve controller of FIG. 2A to transmit a joystick position signal from the joystick controller to the bypass valve controller.

Referring to FIG. 6, a further embodiment of oscillation reduction circuit 210 and controller 228 is shown in which controller 228 receives a signal indicative of incipient oscillation of elongate member 114 from controller 242, which generates the electrical signal that closes solenoid 240. In this embodiment, controller 228 and controller 242 are preferably connected over a serial communication link 274. Controller 242 is configured to generate and send a signal to controller 228 indicative of the position of joystick 244 at least when joystick 244 is moved by the operator to a position indicative of incipient oscillation. As in the embodiments of FIGS. 4 and 5, other than the substitution of the signal line 274 and the added configuration of controller 242 to send a signal on that line, the operation and construction of oscillation reduction circuit 210 and controller 228 are the same as recited above.

Figure 7:
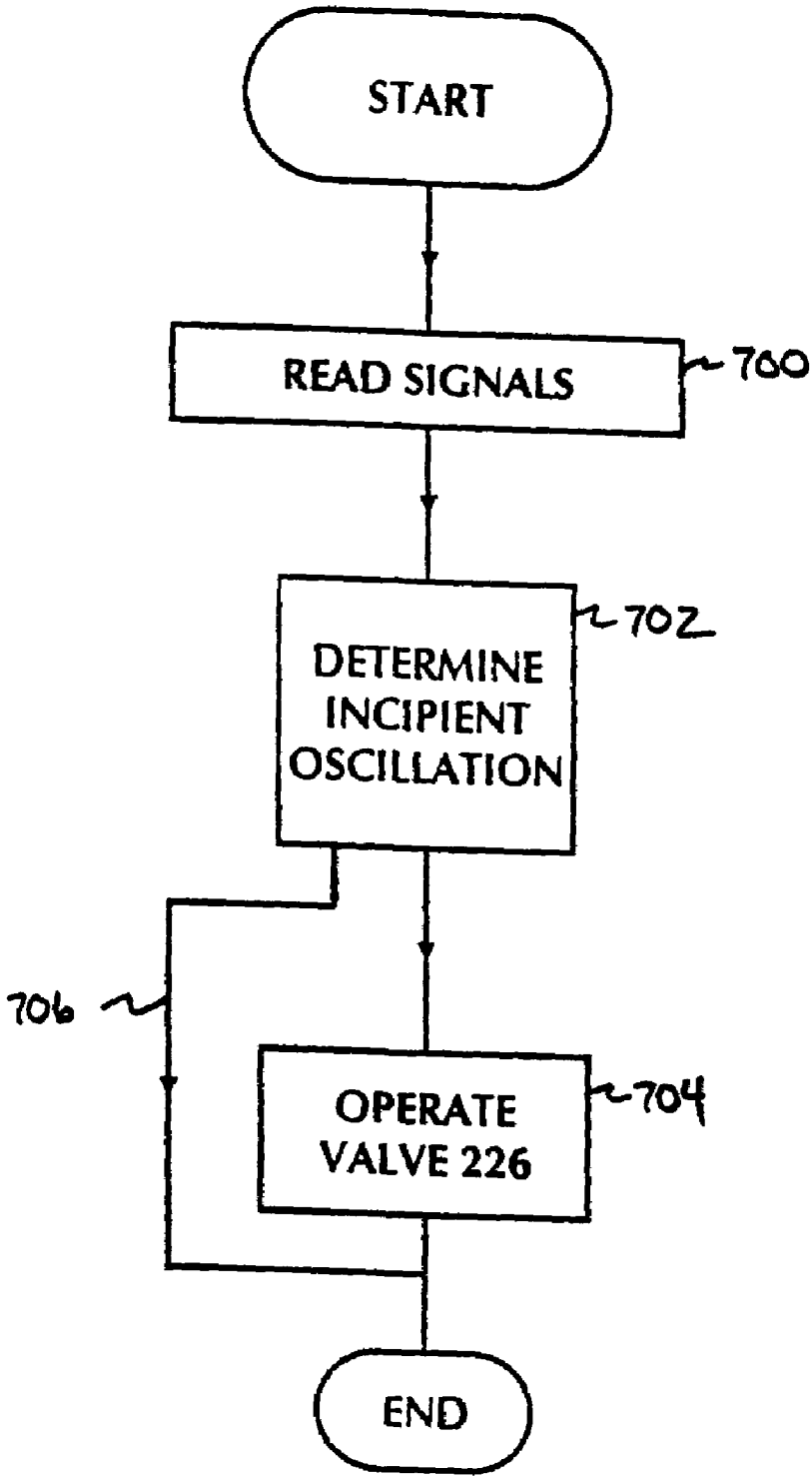
FIG. 7 is a flow chart illustrating the programmed processing steps executed by the controller.

FIG. 7 illustrates a flow chart showing the operation of controller 228 as it gathers data from the sensors and switches, determines whether oscillation is incipient, and if so, energizes valve 226 thereby opening it and permitting a quantity of fluid sufficient to damp the oscillations to pass through the bypass conduit 216.

The steps illustrated in FIG. 7 are embodied as computer program steps stored in ROM 260. These program steps, stored as digital values in ROM 260, are retrieved by microprocessor 256 (FIG. 2) in controller 228 and are sequentially executed by microprocessor 256 to perform the operations described below in FIG. 7. The steps of FIG. 7 are preferably repeated periodically at intervals of 10 milliseconds.

In step 700, the microprocessor reads signals provided by the sensors or switches to which it is coupled. These sensors or switches include the pressure sensors and the switches on valve 212.

In step 702, the microprocessor analyzes these signals to determine whether there is incipient oscillation, and if so, branches to one of two paths. If the microprocessor determines that oscillation is likely to occur in step 702, program flow branches to step 704 in which the microprocessor generates an oscillation-reducing signal and applies that signal to valve 226. When valve 226 receives this oscillation-reducing signal it opens an amount corresponding to the oscillation-reducing signal, thereby permitting fluid to bypass the flow control valve and flow from one port of the boom swing cylinder to the other port.

If the controller determines that oscillation is unlikely to occur in step 702, the controller does not send the oscillation-reducing signal to valve 226, as shown by program flow path 706, which bypasses step 704.

One process for determining whether there is incipient engagement in step 702 includes determining (1) whether the valve 212 is closed and (2) whether the pressure in either one of the boom swing cylinder lines (which are indicative of the pressure in the boom swing cylinders themselves) is above a predetermined level.

When the operator initially opens valve 212, either by using the joystick or by using the manual lever that is mechanically coupled to the joystick, a pressure increase in the boom swing cylinders is to be expected, since the operator, by opening the valve, has deliberately increased the pressure in the boom swing cylinder in order to make the backhoe attachment move.

When the operator closes the valve (or commands the valve to be closed), this indicates that he intends to shut off fluid flow to the boom swing cylinders—to make them stop moving. Any pressure appearing in the boom swing cylinder (or in the hydraulic lines going to the boom swing cylinder) indicate the reaction of the backhoe attachment (the elongate member) as it is being slowed down and therefore indicate incipient oscillation of the backhoe attachment.

Therefore, in step 702 the microprocessor determines that there is incipient oscillation if valve 212 is closed or being closed (indicated by the joystick position signal or the valve 212 position signal) and if the pressure in the boom swing cylinder (indicated by signals from pressure sensors 230 or 232) is above a first predetermined value.

If the valve is closed or closing and the pressure is above the predetermined value, then oscillation is incipient and the microprocessor will signal valve 226 to open in step 704.

When the pressure falls below a second predetermined value (indicating that the cylinder has stopped swinging and therefore oscillation is not incipient) or the operator opens the valve (indicating that the operator is deliberately moving the backhoe attachment) the microprocessor will not open the bypass valve, or if already opened will close the valve by bypassing step 704.

The pressure will remain above the second predetermined pressure while the boom slows to a halt with the valve closed. As the boom approaches a complete halt, the pressure sensed by the microprocessor (which is generated by the moving boom and is due to the inertia of the moving boom acting against the closed valve) will drop to a level below the second predetermined value. At this point, the boom will be sufficiently slowed and its kinetic energy will be sufficiently dissipated by the fluid passing through bypass valve 226 that the microprocessor can close the valve, thus blocking off flow and fixing the boom swing cylinder in position.

The particular values of the first and second predetermined pressures and the degree of restriction provided by valve 226 will vary from vehicle to vehicle depending upon the mass of the backhoe, the velocity of the backhoe, the volumetric capacity of the boom swing cylinders and the operational pressure of the system. Therefore, the degree of restrictiveness of valve 226 (i.e. the size of its opening, the magnitude of the signal applied the valve or the flow capacity of the valve) and the pressure level at which valve 226 is shut off will vary.

What is important is that the pressure level and the flow rate through the valve be selected such that the inertia of the backhoe attachment is sufficiently dissipated by flow through the valve and approaches a non-oscillatory velocity by the time valve 226 is closed.

Alternatively, in step 702, the microprocessor can determine that there is incipient oscillation based upon the operator closing the valve as indicated by the joystick signal (i.e. the operator's valve closing command) or the position of valve 212 (i.e. the actual closing of the valve) as indicated by the signal from the switch coupled to valve 212.

In this configuration, the microprocessor in step 704 opens the valve for a predetermined time interval before closing it in a subsequent loop through the FIG. 7 process when that time interval has expired. It does not depend upon any pressures in conduits 218 and 220. The time interval is on the order of one second or less. Preferably, it is on the order of 600 ms or less. More preferably, it is on the order of 300 ms or less.

In this arrangement the microprocessor opens valve 226 for a time period that is sufficient to damp the oscillations and then closes it automatically. The passage of this time period can be determined, for example, by the microprocessor incrementing a counter value in step 702 or 704 each time it executes the FIG. 7 process (e.g. every 10 milliseconds).

When the counter reaches a predetermined value (i.e. a predetermined time of valve opening has passed) the microprocessor can turn off the valve in step 706. Of course there are other microprocessor-based timing arrangements that would work equally as well in place of incrementing a counter variable during each pass through the loop of FIG. 7, such as a configuring a software-based interrupt or periodic checking of a system clock by the microprocessor. Any of these would permit the microprocessor to determine that a predetermined time period of valve 226 opening had passed.

What is claimed is:

1. A method of controlling a backhoe wherein the backhoe includes a work vehicle, a backhoe implement pivotally coupled to the work vehicle, at least one boom swing cylinder coupled to the implement and to the vehicle to pivot the implement with respect to the vehicle, a bi-directional hydraulic control valve fluidly coupled to the at least one cylinder to control the flow of hydraulic fluid flow thereto, an electronic bypass valve fluidly coupled between two ports of the hydraulic cylinder to permit hydraulic fluid flow therebetween, and an electronic controller electronically coupled to the bypass valve to drive the bypass valve, the method comprising the steps of:

electronically monitoring in the electronic controller at least one physical parameter indicative of the incipient oscillation of the backhoe implement with respect to the vehicle;

determining in the electronic controller whether the incipient oscillation is going to occur;

electronically opening the bypass valve by the electronic controller if the incipient oscillation has been determined to occur in the foregoing step;

maintaining the bypass valve in an open condition for a predetermined period of time until a quantity of fluid sufficient to damp incipient oscillation has passed through the bypass valve; and closing the bypass valve once the quantity of fluid has passed through the bypass valve.

2. The method of claim 1, wherein the step of electronically monitoring includes the step of reading an electronic sensor signal indicative of a pressure in the boom swing cylinder and wherein the step of determining includes the step of determining whether the pressure is indicative of the incipient oscillation.

3. The method of claim 1, wherein the step of electronically monitoring includes the step of reading an electronic sensor signal indicative of a position of the directional valve and wherein the step of determining includes the step of determining whether the position is indicative of the incipient oscillation.

4. The method of claim 1, wherein the predetermined period of time is less than 1 second.

5. The method of claim 4, wherein the predetermined period of time is less than 600 milliseconds.

6. The method of claim 5, wherein the predetermined period of time is less than 300 milliseconds.

7. The method of claim 1, wherein the quantity of fluid in the step of maintaining the bypass valve in an open condition is insufficient to permit the boom to pivot through an angle relative to the work vehicle of more than 10 degrees.

8. The method of claim 7, wherein the quantity of fluid in the step of maintaining the bypass valve in an open condition is insufficient to permit the boom to pivot through an angle relative to the work vehicle of more than 5 degrees.

9. The method of claim 7, wherein the quantity of fluid in the step of maintaining the bypass valve in an open condition is insufficient to permit the boom to pivot through an angle relative to the work vehicle of more than 3 degrees.

* * * * *